US006125818A

United States Patent [19]

Okamoto et al.

[11] Patent Number: 6,125,818

[45] Date of Patent: Oct. 3, 2000

[54] FUEL INJECTOR AND INTERNAL COMBUSTION ENGINE HAVING THE SAME

[75] Inventors: Yoshio Okamoto, Minori-machi; Yzo Kadomukai, Ishioka; Yoshiyuki Tanabe; Yasunaga Hamada, both of Hitachinaka, all of Japan

[73] Assignees: Hiatchi, Ltd., Tokyo; Hitachi Car Engineering Company, Ltd., Ibaraki, both of Japan

[21] Appl. No.: 09/030,082

[22] Filed: Feb. 25, 1998

[30] Foreign Application Priority Data

Mar. 19, 1997 [JP] Japan ..... 9-066076

[51] Int. Cl.[7] ..... F02B 5/00

[52] U.S. Cl. ..... 123/305; 239/466

[58] Field of Search ..... 251/129.14; 239/584, 239/463, 466, 533.3, 86, 87; 123/305, 300, 294

[56] References Cited

U.S. PATENT DOCUMENTS

| | | | |
|---|---|---|---|
| 3,081,952 | 3/1963 | Woodward et al. | 239/464 |
| 3,100,084 | 8/1963 | Biber | 239/463 |
| 4,105,163 | 8/1978 | Davis, Jr. et al. | 239/406 |
| 4,166,577 | 9/1979 | Elwell | 239/102.2 |
| 4,192,466 | 3/1980 | Tanasawa et al. | 239/464 |
| 5,098,016 | 3/1992 | Okamoto et al. | 239/5 |
| 5,713,205 | 2/1998 | Sciocchetti et al. | 60/740 |
| 5,740,777 | 4/1998 | Yamamoto et al. | 123/305 |

FOREIGN PATENT DOCUMENTS

| | | | |
|---|---|---|---|
| 5-33739 | 2/1993 | Japan . | |
| WO 96/36808 | 11/1996 | Japan | 123/305 |

*Primary Examiner*—Henry C. Yuen
*Assistant Examiner*—Hai Huynh
*Attorney, Agent, or Firm*—Anotnelli, Terry, Stout & Kraus, LLP

[57] ABSTRACT

A laminated fuel swirl element is employed, in which a strong swirl force flow is imparted to the fuel at a remote position relative to an injection hole, while on the other hand, at a position near the fuel injection hole, a weak swirl force is imparted to the fuel. A complex solid cone spray can be obtained in this way, which spray has a superior dispersion characteristic obtained by attracting small diameter droplets, which are generated at an outer peripheral portion of the spray, through a spray portion which is generated in the vicinity of a central area of the spray and has a large velocity. As to the spray characteristics in an electromagnetic fuel injector of the direct injection type for use in a gasoline engine, a complex solid cone spray can be obtained, and, as a result a good ignitability of the engine can be obtained by a spray portion having a small spreading angle produced by making the inertia force strong, and the amount of the unburned gas components of the combustion can be reduced by a spray portion having a short distance or extent of travel and a large spreading angle produced by making the inertia force weak.

20 Claims, 7 Drawing Sheets

FUEL INJECTOR AND INTERNAL COMBUSTION ENGINE HAVING THE SAME

BACKGROUND OF THE INVENTION

The present invention relates to a fuel injector and to an internal combustion engine having a fuel injector. More particularly, the invention relates to a fuel injector capable of producing a fuel spray having a superior ignitability and a superior combustibility for use in an internal combustion engine having a fuel injector.

The present invention relates to a fuel injector for forming a complex fuel spray having a superior ignitability and a superior combustibility for use in an internal combustion engine.

An inlet pipe fuel injection device is a device which causes fuel to be injected into an inlet pipe of an internal combustion engine. In addition to an inlet pipe fuel injection device, there is also a direct fuel injection device, which operates to inject fuel directly into a combustion chamber (a cylinder) of the internal combustion engine. Such a direct fuel injection device is disclosed in, for example, Japanese patent laid-open publication No. Hei 5-33,739.

As disclosed in the above stated Japanese patent laid-open publication No. Hei-5 33,739, it is difficult to homogeneously mix fuel which has been injected directly into the combustion chamber with the air being drawn in the combustion chamber. Therefore, it is important to promote the atomizing of the fuel which has been injected directly into the combustion chamber.

To atomize the fuel, up to now, a swirling force has been imparted to the fuel which is injected from a fuel injector. As shown in the above stated Japanese patent laid-open publication No. Hei-5 33,739, a direct fuel injection device having a means for imparting a swirling force to the fuel is disclosed.

Herein, the direct fuel injection device disclosed in the above stated Japanese patent laid-open publication No. Hei-5 33,739, comprises an injection nozzle for injecting fuel from an injection hole, a cylindrical cover having a bottom portion constituting an air chamber at an outer side of the injection nozzle, a swirl chamber which is formed at a side of the bottom portion of the cover so as to communicate with the injection hole of the injection nozzle, and a check valve body which opens and closes the injection hole.

With the above stated conventional direct fuel injection device structure, the swirl chamber has an injection hole and this injection hole introduces air from a tangential direction along an inner peripheral face of the swirl chamber from the air chamber which is constituted in the cylindrical-shaped cover having the bottom portion. In accordance with the above stated air which is injected from the injection hole of the swirl chamber, the fuel injected through the injection hole of the injection nozzle will have a swirl force imparted thereto.

Further, the injection hole and a passage for introducing air from the air chamber into the swirl chamber are provided with a two-stage structure, namely the injection hole and the passage of the swirl chamber are provided at an upper direction and a lower direction (an axial direction of the check valve body) or an upstream side and at a downstream side of the check valve body. Each of the injection hole and the passage of the swirl chamber at the upper direction and the lower direction have the same structure.

However, in the above stated direct fuel injection device, the check valve is arranged at a discharge side. Further, the elements which produce the swirl force are provided at a downstream side of a metering portion of the fuel passage, rather than at an upstream side of the metering portion of the fuel passage.

As a result, after the fuel passes through the metering portion of the fuel passage without having a swirl force imparted thereto, the fuel is subjected to a swirl force for the first time at the downstream side of the metering portion of the fuel passage, namely the swirl force is imparted first in the swirl chamber in response to the applied air.

Accordingly, in the direct fuel injection device structure disclosed in the above stated Japanese patent laid-open publication No. Hei-5 33,739, there is no suggestion to impart the swirl force to the fuel using a portion of the fuel passage upstream of the metering portion of the valve body.

In the conventional technique employed in the above stated direct fuel injection device, the atomization of the fuel is promoted and the spray direction of the fuel and the spreading of the fuel spray have been controlled. However, as stated hereinafter, full consideration has not been given to the shape of the fuel spray, the diameter of the fuel spray and the structure of the fuel spray in which both the ignitability (a spark-in property) and the combustibility (a propagation of fire) are improved in a compatible way.

To attain the optimum property for the spray of fuel which is injected from the fuel injector, it is necessary to consider at least the following three characteristics.

First of all, the first characteristic is the fuel spray shape, and the factors for this fuel spray shape are the spreading angle and the distance or extent of travel of the fuel spray. The second characteristic is the size of a spray fuel particle, in this regard, and it is necessary to lessen the number of spray fuel particles of large size as much as possible and to improve the uniformity of the spray fuel particle size distribution. The third characteristic is the structure of the fuel spray, and, for this purpose, it is necessary to provide a suitable spatial distribution of the fuel particles to be sprayed.

The inventors of the present invention have studied by experimentation various analyses as to how these fuel spray characteristics relate to the combustion properties in the internal combustion engine. As a result of these studies, they have found that, in a case where the spreading angle of the spray of the fuel is large, the inertia force of the fuel spray is weak, with a result that the distance or extent of travel of the fuel spray is short, whereby it is possible to obtain stability in the combustion. Further, on the other hand, by making the spreading angle of the spray of the fuel small, the inertia force of the fuel spray is made strong, with a result that a mixture of air and fuel having a superior ignitability is produced, but it was ascertained clearly that there is a tendency for unburned gas components (HC, CO) in the fuel to increase.

SUMMARY OF THE INVENTION

An object of the present invention is to provide a fuel injector which can inject a complex solid cone of fuel as a spray to provide a fuel spray having a superior combustibility in which the discharge amount of unburned gas components can be reduced and a fuel spray having improved ignitability can be provided for use in an internal combustion engine.

Another object of the present invention is to provide a fuel injector which can inject a spray in the form of complex solid cone of fuel particles to provide a fuel spray having a superior combustibility in which the discharge amount of unburned gas components can be reduced and a fuel spray having an improved ignitability can be provided for use in an internal combustion engine so as to obtain a superior ignitability of the internal combustion engine and to reduce the discharge amount of the unburned gas components in the fuel.

As to the spray formed as a complex solid cone of fuel particles in the fuel injector, it is desirable to form a fuel spray which comprises a first fuel spray having a large spreading angle by the inertia force thereof weak and the distance or extent of travel thereof short, and a second fuel spray having a small spreading angle by making the inertia force thereof strong.

In order to produce such a complex solid cone spray of fuel from a fuel injector, a fuel injector according to the present invention comprises a nozzle body having an injection hole, a valve body, and a drive means for driving the valve body in an axial direction, so that, by driving the valve body, the injection hole is opened and closed and the fuel injection is carried out.

In the fuel injector, at a side upstream of the injection hole, two swirl force producing means for imparting a swirl force to the fuel are arranged in the axial direction, the two swirl force producing means comprise a first swirl force producing means and a second swirl force producing means, whereby the swirl force imparted by the first swirl force producing means differs from the swirl force imparted by the second swirl force producing means, whereby a fuel injection in the form of a solid cone spray is carried out.

In a fuel injector according to the present invention, at a side upstream of the injection hole, two swirl force producing means for imparting a swirl force to the fuel are arranged to have a two stage form in the axial direction, the two swirl force producing means comprise an upstream side swirl force producing means and a downstream side swirl force producing means, with the upstream side swirl force producing means imparting a stronger swirl force to the fuel than the swirl force produced by the downstream side swirl force producing means, whereby a fuel injection in the form of a solid cone spray is carried out.

The fuel to which a strong swirl force is imparted forms a first fuel spray having a large spreading angle by weakening the inertia force and shortening the distance or extent of travel thereof. The fuel to which a weak swirl force is imparted forms a second fuel spray having the small spreading angle due to a strong inertia force. The complex solid cone fuel spray is formed by the first fuel spray and the second fuel spray.

In a fuel injector according to the present invention in which fuel having a swirl force imparted thereto is injected, from an injection hole, a preceding spray is injected to a central portion, and in succession to the preceding spray, another spray is injected radially to a surrounding portion of the preceding spray, whereby fuel injection having a solid cone spray is carried out.

In a fuel injector according to the present invention in which fuel having a swirl force imparted thereto is injected, a cross-section of the spray shape, including an axial center of the valve body of the fuel injector, produces a strong spray distributed in three directions, whereby fuel injection having a solid cone spray is carried out.

The fuel spray at the central portion attracts small diameter droplets, such small diameter droplets are injected continuously into the fuel at a surrounding portion of the fuel spray with a hollow shape spray and with a radial shape spray. As a result, a solid cone fuel spray structure having a superior dispersion property can be formed.

The fuel spray at the central portion is mainly a fuel spray made up of fuel to which is imparted a weak swirl force. The fuel spray which follows the above fuel spray and is injected with a radial shape is mainly a fuel spray made up of fuel to which is imparted a strong swirl force.

According to a high speed photograph of the fuel spray structure during fuel injection, it was observed that the fuel spray which is injected at the central portion reaches a remote location relative to the fuel spray which is sprayed at the surrounding portion a the radial shaped spray. A cross sectional view of the fuel spray structure will show the following characteristics.

Namely, in the fuel injector obtained according to the present invention, which injects fuel while imparting a swirl force to the fuel, the cross sectional view of the fuel spray structure, taken along the axial center of the fuel injection, shows a strong fuel spray extending in three directions.

A fuel injector according to the present invention comprises, at a side of an upstream of the injection hole, two swirl force producing means for imparting a swirl force to the fuel, which are arranged with a two stage form superimposed in the axial direction, the two swirl force producing means comprise an upstream side swirl force producing means and a downstream side swirl force producing means, and the upstream side swirl force producing means imparts a weaker swirl force to the fuel than a swirl force of the downstream side swirl force producing means, thereby a fuel injection with a solid cone spray is carried out.

In a fuel injector according to the present invention in which fuel is injected, while imparting a swirl force to the fuel, from an injection hole, a preceding spray is injected radially into an annular area, and in succession to the preceding spray, another spray is injected to a central portion of the annular area, thereby fuel injection with a solid cone spray is carried out.

A fuel injector according to the present invention comprises a nozzle body having an injection hole for injecting fuel and a seat face provided upstream of the injection hole, a valve body for opening and closing a fuel passage at the seat face of the nozzle body, at a side of an upstream of the seat face of the nozzle body, an element having a penetration hole in which the valve body extends, an axial direction fuel passage for passing fuel in an axial direction and a radial direction fuel passage communicating with the penetration hole from the axial direction passage for passing the fuel in a radial direction.

The radial direction fuel passage includes a first radial direction passage and a second radial passage superimposed in the axial direction, whereby an off-set amount of the first radial direction passage differs from an offset amount of the second radial direction passage, thereby fuel injection with a solid cone spray is carried out.

An off-set amount from an axial center of the valve body of one of the two radial direction passages, which is provided at a relatively remote position from the injection hole and communicates with the penetration hole at an upstream side thereof, is made the same or larger than an off-set amount of an opening of the other radial direction passage which is provided relatively near the injection hole, thereby fuel injection with a solid cone spray is carried out.

According to the above stated fuel injector, the flow direction of the fuel which passes through the radial direction passage remote from the injection hole is angled away from the axial center of the valve body as compared to the flow of the fuel which passes through the radial direction passage near to the injection hole. As a result, the fuel which has imparted the strong swirl force at the upstream side is injected continuously from the injection hole to the fuel which has imparted the weak swirl force at the downstream side. For reasons stated above, a complex solid cone fuel spray is formed.

A fuel injector according to the present invention comprises,m an upstream of the seat face of the nozzle body, an element having a penetration hole in which the valve body extends, an axial direction fuel passage for passing fuel in an axial direction and a radial direction fuel passage communicating with the penetration hole from the axial direction fuel passage for passing the fuel in a radial direction.

The radial direction fuel passage includes two radial direction passages which are provided with a two stage form superimposed in the axial direction, an off-set amount from an axial center of the valve body of one of the two radial direction passages, which is provided at a position relatively remote from the injection hole in communication with the penetration hole at an upstream side thereof, is made smaller than an off-set amount of the other radial direction passage, which is provided relatively near the injection hole, thereby fuel injection with a solid cone spray is carried out.

An internal combustion engine having a fuel injector with the features described above, according to the present invention, comprises a cylinder, a piston which reciprocates in the cylinder, an air intake means for introducing air into the cylinder, a discharge means for discharging combustion gas from the cylinder, a fuel injector for directly injecting fuel into the cylinder, a fuel supply means for supplying fuel from a fuel tank to the fuel injector, and an ignition means for igniting a mixture of air and fuel which comprises air introduced in the cylinder by the air intake means and fuel injected into the cylinder by the fuel injector, the internal combustion engine.

The piston of the engine has a cavity portion at an upper face thereof and the cavity portion changes the direction of the spray which is injected from the fuel injector to deflect it to the ignition means.

According to the internal combustion engine obtained by the present invention, as stated in above, since a complex fuel spray is formed in the cylinder, a superior ignitability is achieved in the internal combustion engine and the combustibility in the internal combustion engine can be improved, as a result of which, the discharge amount of unburned gas components of the combustion can be reduced.

Since the fuel is injected toward the cavity portion which is constituted on the upper face of the piston, the fuel spray having a strong inertia force which has imparted a weak swirl force collides vigorously with the cavity portion and the direction of the fuel is changed to deflect it toward the ignition device (an ignition plug). Since the fuel which is changed in direction and has a strong inertia force attracts small diameter droplets at the surrounding portion to further promote fuel dispersion, the ignitability can be improved and the combustibility in the internal combustion engine can be improved further.

DESCRIPTION OF THE INVENTION

Figure 9:
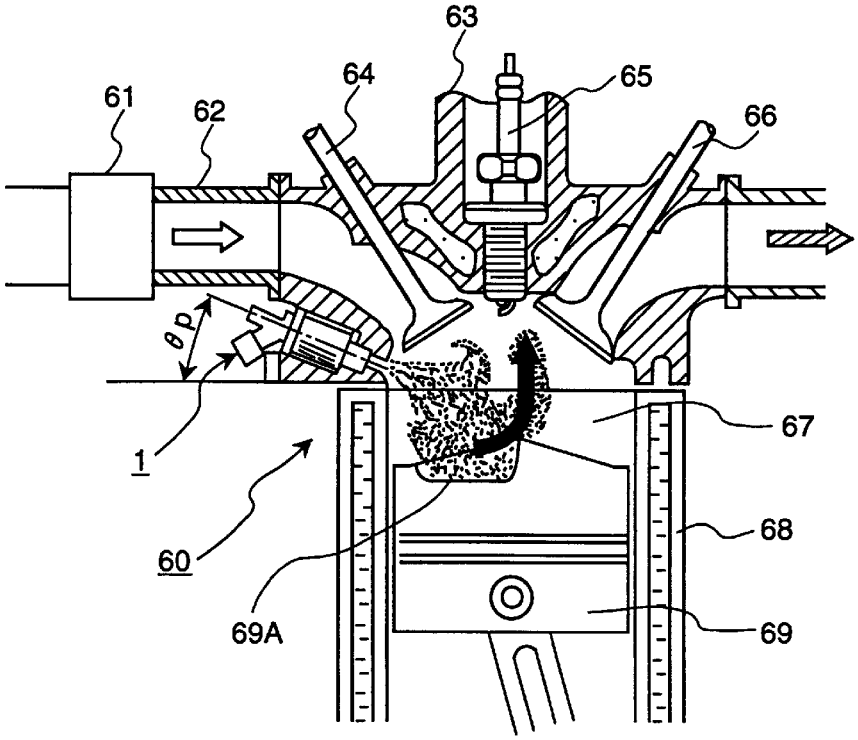
FIG. 9 is an explanatory view showing one embodiment of an essential portion of a direct injection system internal combustion engine having a fuel injector according to the present invention.

Reference will be made first of all to FIG. 9, which shows a direct fuel injection device, representing the subject matter which has been studied by the inventors of the present invention, and an internal combustion engine on which the direct fuel injection device is mounted.

The direct fuel injection device (hereinafter referred to as an electromagnetic fuel injector) is installed in the cylinder head of the engine with an inclination of 30°–40° degree. The injection direction of the fuel is directed toward a piston cavity (a recessed portion provided on the piston). To obtain a fuel spray having an optimum property from this kind of the electromagnetic fuel injector, it is necessary to study the following characteristics.

The first characteristic is the fuel spray shape. The factors for the fuel spray shape are comprised of the spreading angle and the distance or extent of travel of the fuel. The second characteristic is the size of a spray fuel particle. In this regard, it is necessary to lessen the number of fuel particles of large size as much as possible and to make fuel particle size distribution uniform. The third characteristic is the fuel spray structure. For this, it is necessary to provide a suitable spatial distribution of the fuel particles to be sprayed.

The inventors of the present invention have studied by experimentation how these fuel spray characteristics relate to the combustion properties in an internal combustion engine. As a result of these studies, they have found that, when the spreading angle of the fuel spray is made large, the inertia force of the fuel spray is made weak, with a result that the distance or extent of travel of the fuel is short, which is effective to obtain stability in the combustion. Further, on the other hand, when the spreading angle of the fuel spray is short, the inertia force of the fuel spray is made strong, with the result that a mixture air and fuel having a superior ignitability is produced; however, it has been ascertained clearly that, in this case, there is a tendency for unburned gas components (HC, CO) in the fuel to increase.

The following embodiments of a direct fuel injection device or a fuel injector, and of an internal combustion engine on which the direct fuel injection device or the fuel injector is mounted, according to the present invention are based on the above stated findings.

Figure 1A:
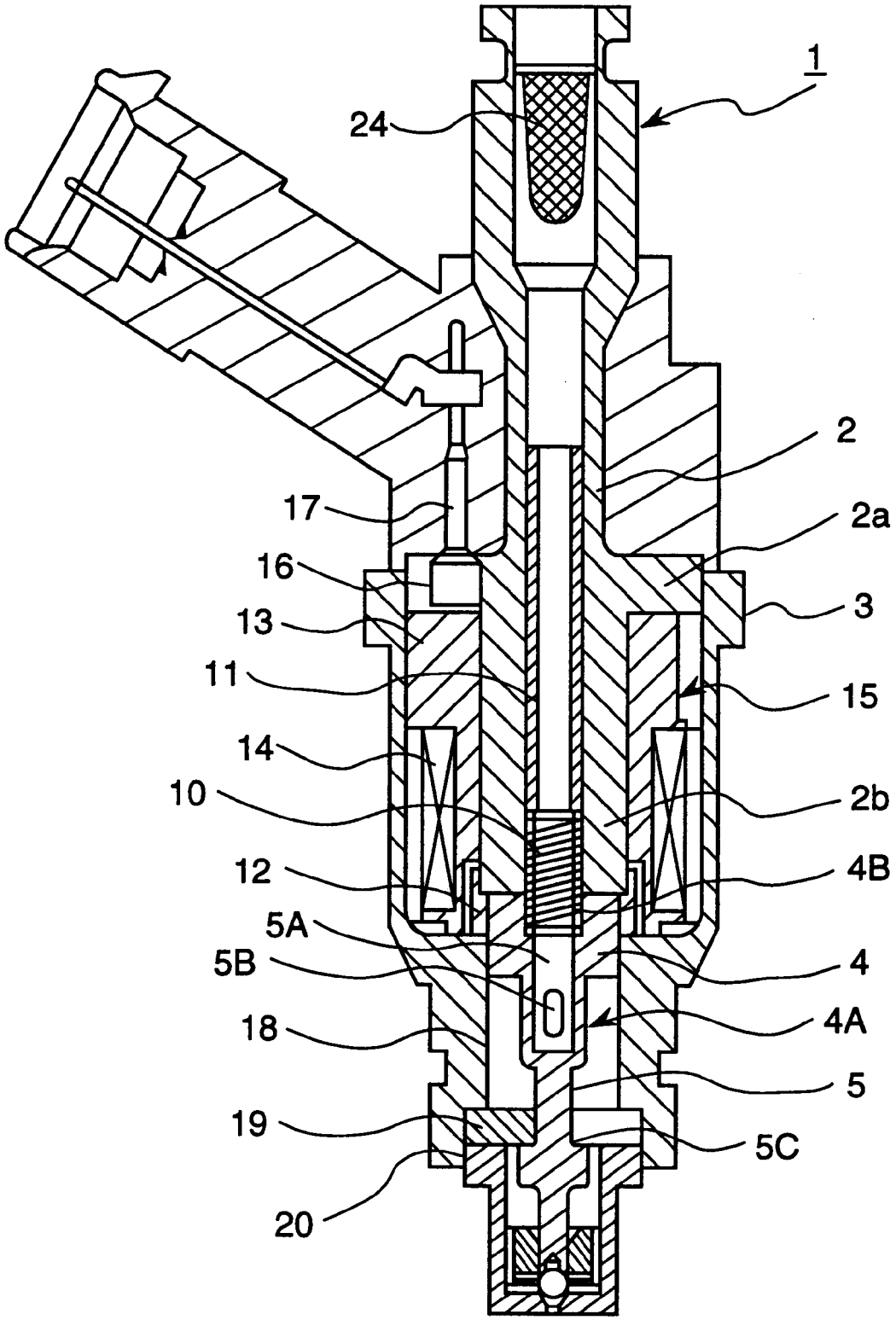
FIG. 1A is a cross-sectional view showing one embodiment of an electromagnetic fuel injector according to the present invention.

Hereinafter, one embodiment of a fuel injector according to the present invention will be explained with reference to FIGS. 1A and 1B, FIG. 2A–FIG. 2E and FIG. 3B. FIG. 1A is a cross-sectional view of one embodiment of an electromagnetic fuel injector according to the present invention. Using FIG. 1A, the structure and operation of the electromagnetic fuel injector 1 will be explained.

Figure 1B:
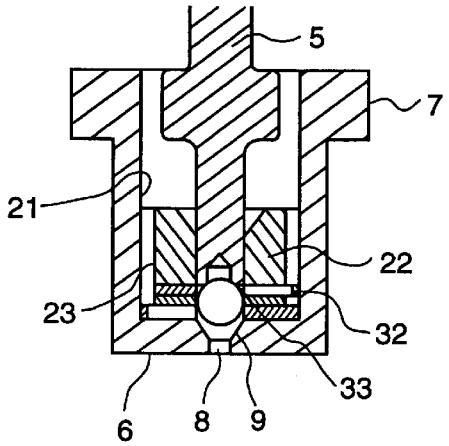
FIG. 1B is a longitudinal cross-sectional view of a movable valve of a laminated layer fuel swirl element for use in the electromagnetic fuel injector of FIG. 1A according to the present invention.
Figure 1C:
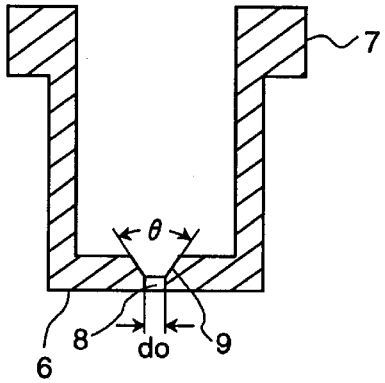
FIG. 1C is a longitudinal cross-sectional view of a nozzle member, which has a valve seat angle θ and a fuel injection hole diameter do, for use in the electromagnetic fuel injector of FIG. 1A according to the present invention.

FIG. 1B is a longitudinal cross-sectional view of a movable valve of a laminated layer fuel swirl element of the electromagnetic fuel injector, and FIG. 1C is a longitudinal cross-sectional view of a nozzle member which has a valve seat angle θ and a fuel injection hole diameter do for use in the electromagnetic fuel injector.

The electromagnetic fuel injector 1 performs an open and close operation on a seat portion in response to an ON-OFF signal having a duty factor which is controlled by a control unit to carry out an injection of fuel. A magnetic circuit for the fuel injector comprises a cylindrical yoke 3 having a bottom portion, a core 2 having a plug body portion 2*a* for closing an opening end of the yoke 3 and a column shaped portion 2*b* which extends over a central portion of the yoke 3, and a plunger 4 which is faced to the core 2 with a gap.

Inside the column shaped portion 2*b* of the core 2, a movable portion 4A and an axial hole 4B are provided. The movable portion 4A comprises a plunger 4, a rod 5, and a ball 6. The axial hole 4B holds a spring member 10 serving as an elastic member, and this spring member 10 is inserted in the hole 4B so as to press the ball 6 against a seat face 9 of an upstream side of a fuel injection hole 8 via the rod 5. The fuel injection hole 8 is formed in a nozzle member 7 and allows fuel to pass therethrough when the ball 6 is withdrawn from the seat face 9.

An upper end of the spring member 10 is in contact with a lower end of a spring adjuster 11, which is inserted central hole 4B of the core 2 to adjust the spring member 10 to a set load. A seal ring 12 is provided at a clearance portion which exists between an end of the column shaped portion 2*b* of the core 2 and an end of the plunger 4 of the movable portion 4A in the yoke 3. This seal ring 12 prevents an outflow of the fuel into the area of the coil 14 and is fixed mechanically between the column shaped portion 2*b* of the core 2 and the movable portion 4A.

The coil 14 for exciting the magnetic circuit is wound on a bobbin 13, and the outer periphery of the coil 14 is molded by a plastic member. A terminal 17 of the coil assembly body 15, which comprises the coil 14 and the bobbin 13, is inserted in a hole 16 which is provided in the radial portion 2*a* of the core 2. This terminal member 17 is connected with the control unit (not shown in figure) for operation of the fuel injector.

At the bottom portion of the yoke 3, a plunger receiving portion 18 for receiving the movable portion 4A is opened, and a further plunger receiving portion 20 extends through to a tip end of the yoke 3. The further plunger receiving portion 20 has a larger diameter than a diameter of the plunger receiving portion 18, and further a stopper member 19 and the nozzle member 7 are mounted therein.

The movable portion 4A comprises the plunger 4 made of a magnetic material, the rod 5 having one end thereof integrally formed with the plunger 4 and the ball 6 which connected to a tip end portion of the rod 5. At a side of the plunger 4 of the rod 5, a cavity portion 5A having an axial fuel passage is provided for allowing the passage of the fuel axially therein. In this cavity portion 5A, an outflow port 5B for the fuel is provided.

Further, movement in the axial direction of the movable portion 4A is guided by the contact between the outer periphery of the plunger 4, the inner peripheral surface of the plunger receiving portion 18 and the seal ring 12. In the vicinity of an end portion of the rod 5, to which the ball 6 is bonded, the movable portion 4A is guided along an inner peripheral face 23 of a laminated layer fuel swirl element 22 according to the present invention, which is inserted in a hollow interior portion of the nozzle member 7.

In the nozzle member 7, the laminated layer fuel swirl element 22 for guiding the end portion of the rod 5, on which the ball 6 is bonded, is provided above the seat face 9 for seating the ball 6. At a central portion of a downstream side of the seat face 9, the fuel injection hole 8 for allowing the passage of the fuel is provided in the nozzle member 7. The fuel injection hole 8 has a diameter do and the valve seat face 9 of the nozzle member 7 has an angle θ, as seen in FIG. 1C.

Further, the stroke (a movement amount in an axial upper portion) of the movable portion 4A is determined by the size of a gap which is formed between a receiving face 5C of a neck portion of the rod 5 and the stopper member 19. Further, a fuel filter 24 is provided to prevent entry of dust and foreign matter in the fuel and in the piping extending to the valve seat.

Now, the structure of the laminated layer structure fuel swirl element 22 of the electromagnetic fuel injector 1 according to the present invention will be explained in more detail.

Figure 2A:
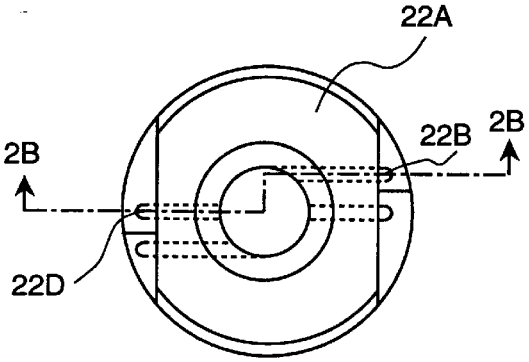
FIG. 2A is a plane view showing a laminated layer fuel swirl element for use in the electromagnetic fuel injector of FIG. 1B according to the present invention.
Figure 2B:
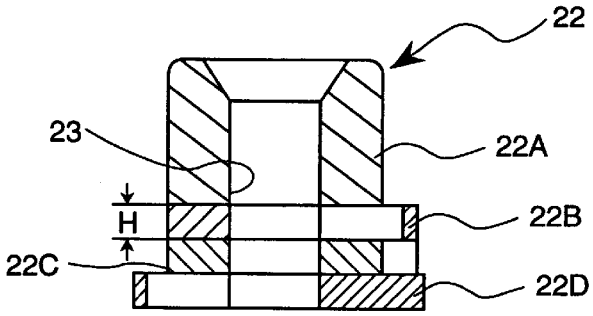
FIG. 2B is a longitudinal cross-sectional view showing the laminated layer structure swirl element of the electromagnetic fuel injector, taken along a line 2B—2B in FIG. 2A, according to the present invention.

FIG. 2A is a plane view showing one embodiment of a laminated layer fuel swirl element 22 of the electromagnetic fuel injector 1; FIG. 2B is a longitudinal cross-sectional view of the laminated layer structure swirl element 22 of the electromagnetic system fuel injector 1; and FIG. 2C is a plan view showing an upper plate 22B for the fuel passage of the laminated layer fuel swirl element 22 of the electromagnetic fuel injector 1.

Figure 2C:
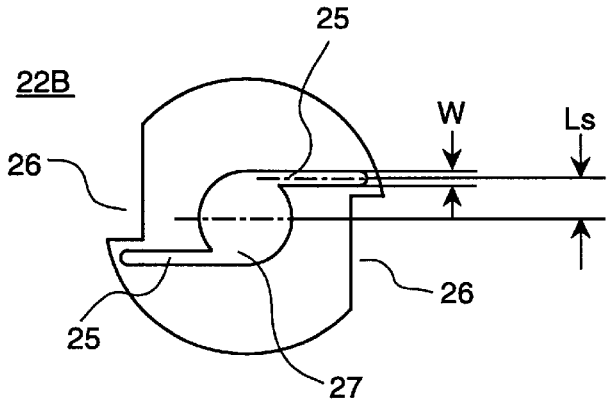
FIG. 2C is a plan view showing an upper plate 22B for constituting a fuel passage of the laminated layer fuel swirl element of the electromagnetic fuel injector of FIG. 2B according to the present invention.
Figure 2D:
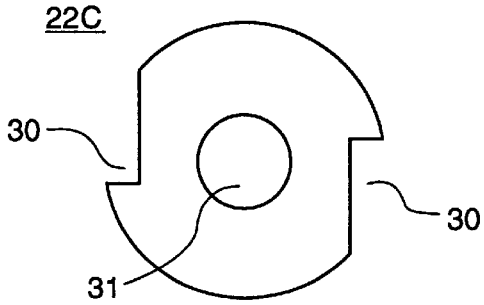
FIG. 2D is a plan view showing a middle plate 22C for constituting a fuel passage of the laminated layer fuel swirl element of the electromagnetic fuel injector of FIG. 2B according to the present invention.
Figure 2E:
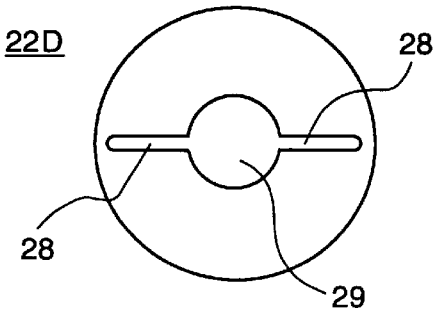
FIG. 2E is a plan view showing a lower plate 22D for constituting a fuel passage of the laminated layer fuel swirl element of the electromagnetic fuel injector of FIG. 2B according to the present invention.

FIG. 2D is a plan view showing a middle plate 22C for the fuel passage of the laminated layer structure fuel swirl element 22 of the electromagnetic system fuel injector 1; FIG. 2E is a plan view showing a lower plate 22D for the fuel passage of the laminated layer structure fuel swirl element 22 of the electromagnetic system fuel injector 1; and FIG. 3B is a plan view showing a modified lower plate 22D' for the fuel passage of a laminated layer fuel swirl element of the electromagnetic fuel injector 1.

The laminated layer fuel swirl element 22, as shown in FIG. 2B, comprises four pieces which include a cylindrical portion 22A, an upper plate 22B, a middle plate 22C, and a lower plate 22D. The cylindrical portion 22A has an axial guide hole 23 for guiding the end of the movable portion 4A.

Further, the upper plate 22B, as shown in FIG. 2C, has a pair of radial direction fuel passages 25 which are off-set respectively by a value of Ls from a center axis thereof and two notch portions 26, as well as a hole 27 at a central portion. The central hole 27 communicates with the radial direction fuel passages 25.

Further, the lower plate 22D has a pair of radial direction fuel passages 28, which are not off-set, and a hole 29 at a central portion thereof, as shown in FIG. 2E. The central hole 29 communicates with the radial direction fuel passages 28. However, as shown in FIG. 3B, each of the radial direction fuel passage 28' of the lower plate 22D' also can be formed to have an off-set amount (LS') (more than O) smaller than the off-set amount (Ls) of the radial direction fuel passage 25 of the upper plate 22B shown in FIG. 2C. In other words, the off-set amount of the radial direction fuel passages in the lower plate 22 can be set to obtain a desirable fuel spray in which the range of the swirl force imparted from the radial direction fuel passages is smaller than the range of the swirl force imparted from the radial direction fuel passage 25. Further, each of the central holes 27, 31, and 29, which are provided on each of the upper plate 22B, the middle plate 22C, and the lower plate 22D, respectively, has the same diameter, or a little larger diameter, than a diameter of the guide hole 23 of the cylindrical portion 22A. In this regard, each of the plates 22B, 22C, and 22D is manufactured by punching out a very thin plate member having a disc shape, and each of the holes 27, 31 and 29 and each of the notch portions 26 and 30 are formed with a similar press working.

As stated in above, since each of the plates 22B, 22C, and 22D is manufactured by a press working, the degree of design freedom of the shape of each of the plates 22B, 22C, and 22D is high. For example, as to the provision of plural radial direction fuel passages, the provision of a very slim fuel passage, the provision of a complicated fuel passage having a curved line, and complicated and various shaped plates can be manufactured with a high accuracy and at a low cost.

The four pieces which make up the fuel swirl element 22, including the cylindrical portion 22A and the three plates 22B, 22C, and 22D, are laminated in series as shown in FIG. 2B, and, after that, they are fixed under pressure. This laminated layer fuel swirl element 22 of the fuel injector 1 is inserted and fixed to an inner wall of the hollow portion of the nozzle member 7, and then the axial direction passage for the fuel is formed between an outer peripheral wall of the fuel swirl element 22 and the inner wall of the hollow portion of the nozzle member 7.

Further, by inserting end of the movable portion 4A in the guide hole 23, a fuel swirl chamber 33 is formed at an outer peripheral portion of the ball 6. Namely, the fuel passage in which the fuel is introduced from an upper portion of the valve body is constituted, and the fuel which has passed in an axial direction through the fuel passage 32 is introduced eccentrically from an axial center by the radial direction fuel passage 24 of the upper plate 22B. As a result, the fuel has a swirl imparted. Here, the swirl strength to be imparted (a swirl number S) is indicated by a following formula.

$$S=(\text{angular movement amount})/(\text{injection axial direction movement amount})\times(\text{orifice radius})=(2\times do\times Ls)/(n\times ds^2\times\cos\theta/2)$$

Where, do: fuel injection hole diameter (orifice radius) (confer, FIG. 1C)

Ls: radial direction passage eccentricity amount (confer, FIG. 2C)

n: radial direction fuel passage number

θ: valve seat angle (confer, FIG. 1C)

ds: hydraulic equivalent diameter, ds is expressed using a width W and a height H of the radial direction fuel passage. (confer, FIG. 2B and FIG. 2C). Here, $$ds=(2\times W\times H)/(W+H)$$

When, the swirl number S is made large, the atomization is promoted and a fuel spray having a large spreading angle in which the inertia force is weak is formed.

As understood from the above stated formula, the parameters for controlling the swirl force include the off-set amount (Ls) of the fuel passage, the number (n) of fuel passages and the hydraulic equivalent diameter (ds). Accordingly, to change the swirl force, in place of adjustment of the off-set amount (Ls) according to this embodiment of the fuel injector 1, it is possible to change the number (n) of the fuel passages or the hydraulic equivalent diameter (ds). However, in the latter case, since a difference in pressure loss is generated in the fuel passage, the distribution of the flow amount of fuel which flows into each of the fuel passages differs.

As a result, it is necessary to design the fuel swirl element 22 by taking into the consideration the above stated points. On the other hand, since the off-set amount (Ls) of the fuel passage has little affect on the above stated points, it can be easily implemented. However, in a case where the design is carried out by giving full consideration to the above stated points, as to the plural stage arrangement of the radial direction fuel passages, it is possible to change the number (n) of fuel passages or the hydraulic equivalent diameter (ds).

Next, the operation of this embodiment of the fuel injector 1 thus constituted according to the present invention will be explained.

The fuel injector 1 performs an opening and closing operation of the fuel injection hole 8 by moving the ball 6 relative to the seat face 9 of the valve body of the nozzle member 7 by reciprocating downwardly the movable portion 4A upward and downward in the axial direction in response to an electric ON-OFF signal which is supplied to the electromagnetic coil 14, with the result that injection control of the fuel is carried out.

When the electric signal is supplied to the coil 14, the core 2, the yoke 3 and the plunger 4 form a magnetic circuit, and the plunger 4 is attracted upwardly toward the core 2. When the plunger 4 is moved, the ball 6, which is integrally formed with the plunger 4, is moved, and then the ball 6 is separated from the seat face 9 of the valve body of the nozzle member 7, so that the fuel injection hole 8 is opened.

Figure 8:
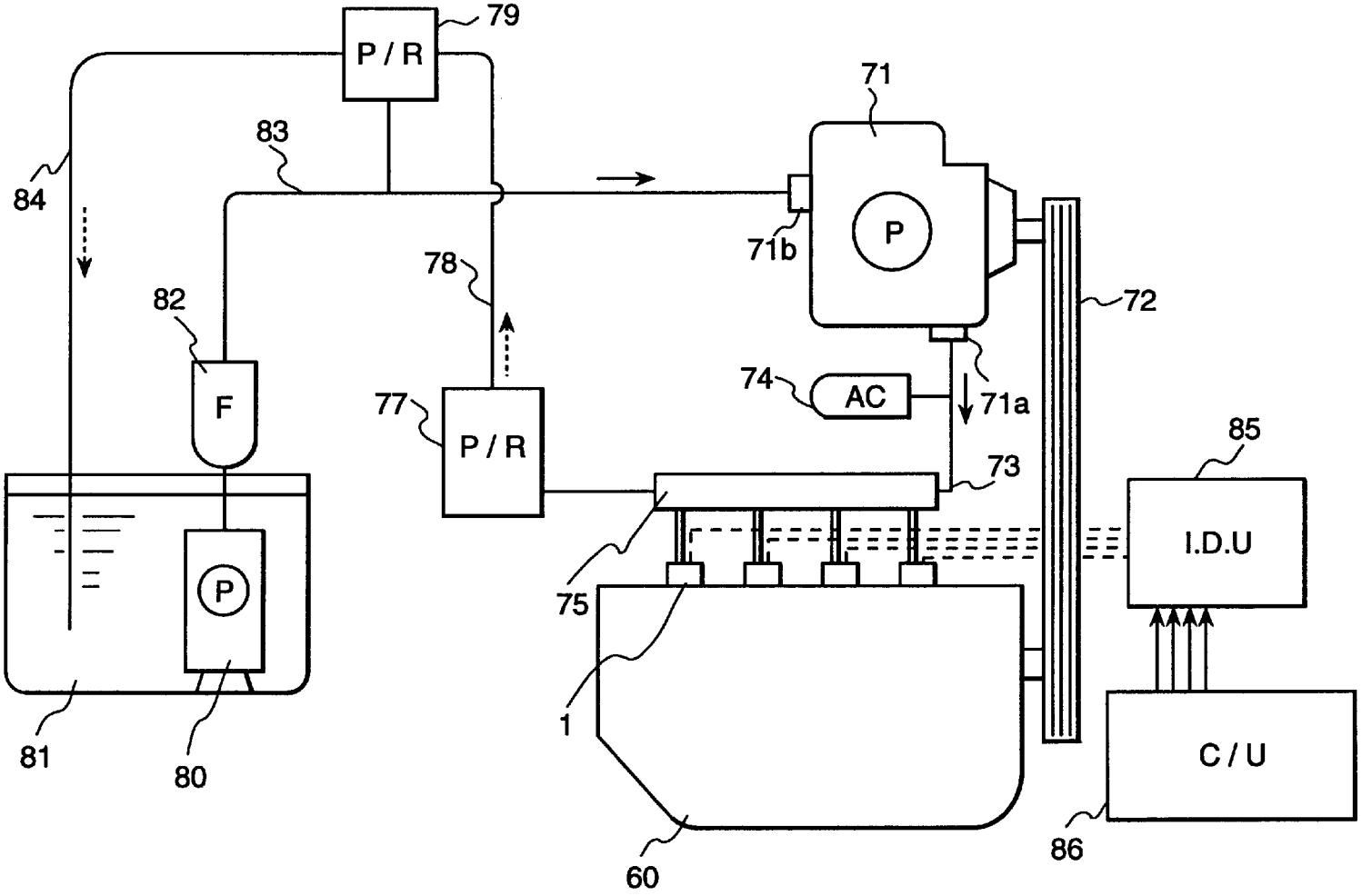
FIG. 8 is a block diagram showing one embodiment of an internal combustion engine having a fuel injector according to the present invention.

As shown in FIG. 8, the fuel is pressurized and adjusted through a fuel pump 80 and a fuel pump 71 and a regulator 79 for adjusting the fuel pressure. The fuel flows into an inner portion of the fuel injector 1 through the filter member 24. And, an inner passage of the core 2 and the hollow portion 5A, which is provided in the plunger 4, form a passage for the fuel, through which the fuel flows downstream through the outflow port 5B to the outer peripheral portion of the plunger 4.

The fuel passes through the gap formed between the stopper member 19 and the rod 5 and through the radial direction fuel passages 25 and 26 of the fuel swirl element 22, where the fuel is swirled and supplied to the seat portion of the nozzle member 7. Accordingly, during the valve opening condition of the nozzle member 7, the fuel is injected from the fuel injection hole 8 into the combustion chamber of the internal combustion engine.

Figure 7A:
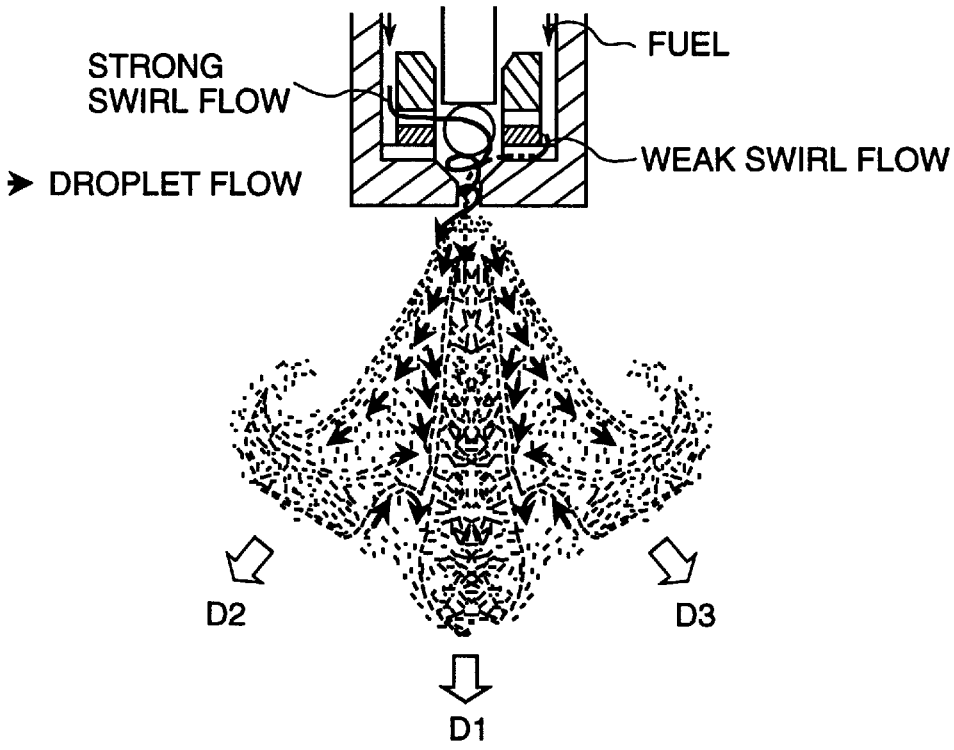
FIG. 7A is a schematic view showing a complex fuel spray structure in which the droplet flow is mainly illustrated according to the present invention.
Figure 7B:
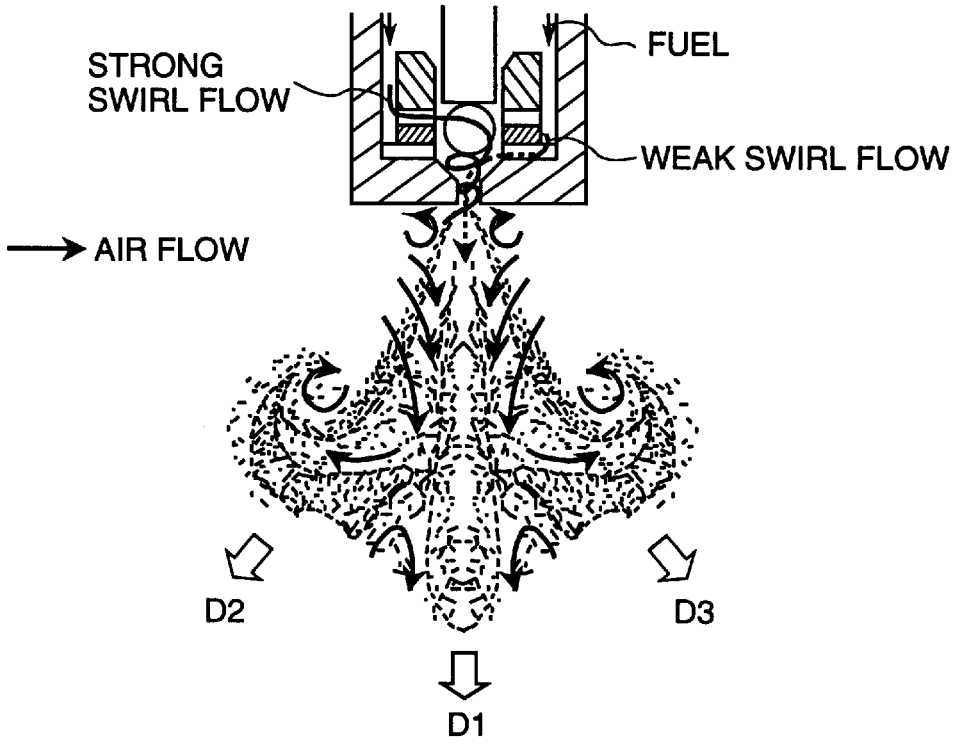
FIG. 7B is a schematic view showing a complex fuel spray structure in which the air flow is mainly according to the present invention.

As shown in FIG. 7A and FIG. 7B, the injected fuel becomes a complex fuel injection spray (a comparatively solid cone fuel spray) in which a spray having a weak swirl force and a large spreading angle and a spray having a strong swirl force and a small spreading angle are mixed. Namely, the spray having the weak swirl force and the large spreading angle is generated by the upper plate 22B, which is arranged further from the seat face 9 of the nozzle member 7 and promotes an atomization property according to the swirl force which is imparted to the fuel by the radial direction fuel passage 25. On the other hand, the spray having the strong swirl force and the small spreading angle is generated by the lower plate 22D, which is arranged nearer to the seat face 9 of the nozzle member 7 and imparts a weak swirl force to the fuel in comparison with the above stated swirl force and is generated in the vicinity of the axial center as a spray flow having a large velocity.

The radial direction fuel passage 28 of the lower plate 22D has an off-set amount of zero (0), but in a case where the fuel is pushed out by the strong swirl flow from the radial direction fuel passage 25 of the upper plate 22B, a swirl force is imparted and the fuel presents a weak swirl flow.

The spray flow from the radial direction fuel passage 28, which imparts a weak swirl flow to the fuel, attracts surrounding air and also attracts small diameter droplets, which produces an atomization in response to the strong swirl flow from the radial direction fuel passage 25. As a result, a fuel spray which presents a comparatively solid cone fuel spray structure is generated.

Figure 3A:
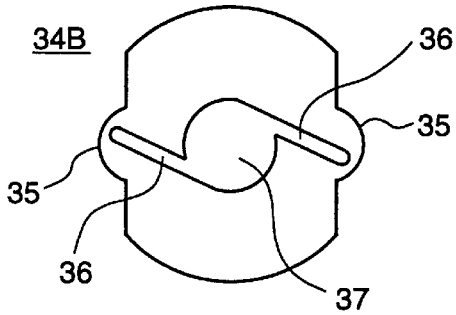
FIG. 3A is a plan view showing another example of the upper plate 34B for constituting a fuel passage of a laminated layer fuel swirl element of an electromagnetic fuel injector according to the present invention.
Figure 3B:
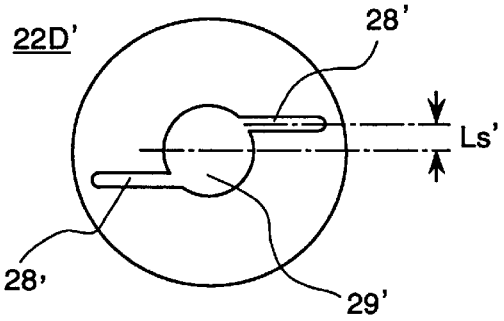
FIG. 3B is a plan view showing another example of the lower plate 22D' for constituting a fuel passage of a laminated layer fuel swirl element of an electromagnetic fuel injector according to the present invention.

FIG. 3A shows another embodiment of an upper plate 34B of a laminated fuel swirl element for use in the fuel injector 1 according to the present invention, and this embodiment forms a modified example of the radial direction passage 25 shown in FIG. 2C of the fuel. Namely, the upper plate 34B forms a semi-circular portion 35 in place of the notch portion shown in FIG. 2*c*. In this semicircular portion 35, an end of the radial direction fuel passage 36 is constituted. The radial direction fuel passages 36 with a central hole 37 provided in the upper plate. In this embodiment of the fuel injector 1, the fuel is imparted fully with a swirl force and the atomization property of the fuel is promoted, so that a fuel spray having a slow velocity and a weak inertia force is generated.

Figure 4A:
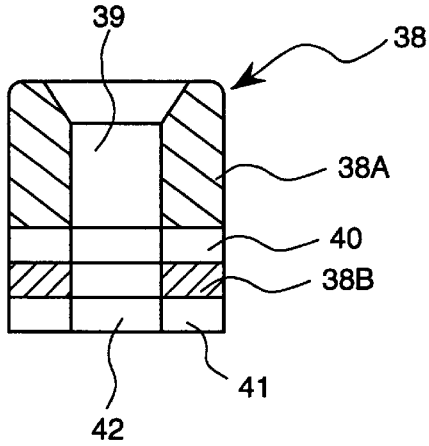
FIG. 4A is a longitudinal cross-sectional view showing a further embodiment of a laminated layer fuel swirl element of an electromagnetic system fuel injector according to the present invention.
Figure 4B:
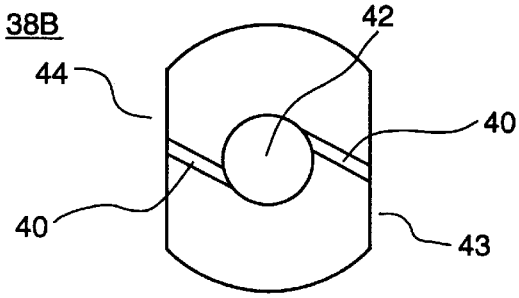
FIG. 4B is a plan view showing a single plate 38B for constituting the laminated layer fuel swirl element of the electromagnetic fuel injector of FIG. 4A according to the present invention.
Figure 4C:
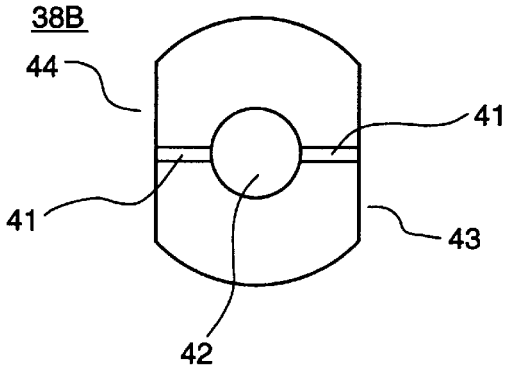
FIG. 4C is a bottom view showing the single plate 38B for constituting the laminated layer fuel swirl element of the electromagnetic fuel injector of FIG. 4A according to the present invention.

FIG. 4A, FIG. 4B and FIG. 4C show a further embodiment of a laminated layer fuel swirl element 38 for use in the fuel injector 1 according to the present invention, and this embodiment shows a two-piece fuel swirl element 38. FIG. 4A shows a longitudinal cross-section view of the two-piece fuel swirl element 38, FIG. 4B is a plan view showing a single plate 38B for constituting a further embodiment of the laminated layer fuel swirl element 38, and FIG. 4C is a bottom view showing the single plate 38B for constituting the further embodiment of the laminated layer fuel swirl element 38.

Namely, the two-piece fuel swirl element 38 is comprised a cylindrical portion 38A and another cylindrical portion (a single plate) 38B. The two parts of the fuel swirl element 38 are separate, but are joined and fixed to the inner wall 21 in the nozzle, and in the cylindrical portion 38A a guide hole 39 for guiding the movable portion 4A of the plunger 4 is provided. Further, at one end face forming an upper face of the other cylindrical portion (the single plate) 38B, a pair of radial direction fuel passages 40 is provided, and the radial direction fuel passages 40 are off-set from the axial center. At the other end face forming the lower face of the cylindrical portion 38B, a pair of radial direction fuel passages 41 is provided, but these radial direction fuel passages 41 are not off-set.

Further, at a central portion, a central hole 42 is provided and this central hole 42 communicates with the respective radial direction fuel passages 40 and 41. This central hole 42 is formed to have the same diameter, or a little larger diameter, as that of the guide hole 39 which is provided in the cylindrical portion 38A of the fuel swirl element 38. Further, on the cylindrical portion 38A and the other cylindrical portion (the single plate) 38B, as shown in FIG. 4B and FIG. 4C, a pair of cut faces 43 and 44 are provided.

When the cylindrical portion 38A and the another cylindrical portion 38B are inserted and fixed to the inner wall 21 at the central portion of the nozzle member 7, between the two cut faces 43 and 44 and the inner wall 21 at the central portion, a space is formed which communicates with the radial direction fuel passages.

Since the cylindrical portion 38B of this embodiment of the fuel injector 1 is manufactured similar to that of the first embodiment, using press working, the degree of freedom degree of design of the radial direction fuel passages 40 and 41 is comparatively high, and it is possible to manufacture the nozzle member with a high accuracy, so that the operation and effects similar to the first embodiment are obtained.

In the fuel swirl element of the fuel injector, it is possible for the off-set amount of a radial direction swirl fuel passage on the upstream side to be the same as the off-set amount of the radial direction swirl fuel passage on the downstream side. In this case, the swirl force which is imparted at the upstream side is weakened by the friction loss of a flow in which the fuel flows from an outlet port of the fuel swirl passage to the injection hole and is composed or joined to a strong swirl force which is imparted at the downstream side.

Since the swirl force at the upstream side is smaller than that of the downstream side, the following complex fuel spray is formed. Namely, after the fuel spray having a weak inertia force and a large spreading angle is produced, a fuel spray having the strong inertia force and a small spreading angle comes in the preceding fuel spray. After an arbitrarily selected time, this fuel spray has a droplet spatial distribution on a fuel spray lateral cross sectional face (at a lower portion of 50 mm from the injection hole) similar to that of the first embodiment.

Further, in a case where the off-set of the fuel swirl passage at the upstream side is smaller than that of the fuel swirl passage at the downstream side, needless to say, the above stated phenomenon becomes remarkable.

The structure of the internal combustion engine or the injection system suitable for the complex fuel spray produced by the fuel injector are not limited to this embodiment, but they can be constituted with the most suitable form for carrying out the embodiments of the complex fuel spray using the fuel injector according to the present invention.

Figure 5:
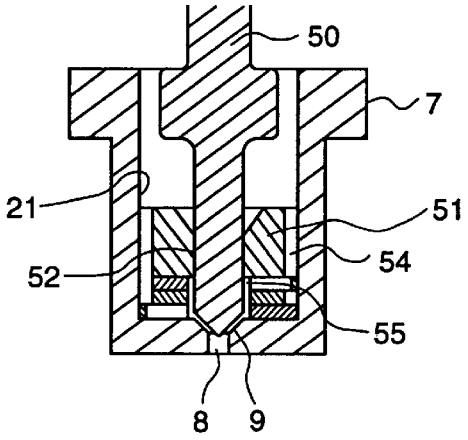
FIG. 5 is a cross-sectional view showing a further embodiment of a movable valve of a fuel swirl element of an electromagnetic fuel injector according to the present invention.
Figure 6:
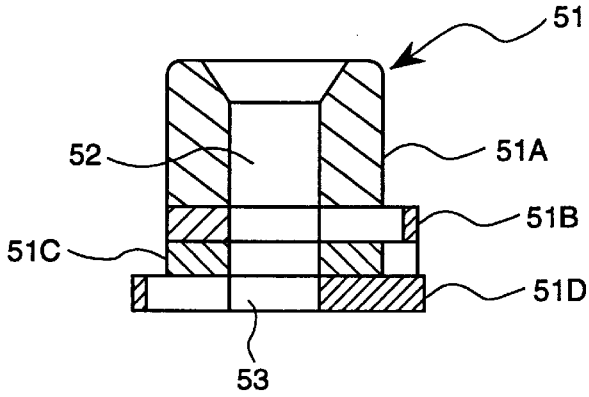
FIG. 6 is a longitudinal cross-sectional view showing a still further embodiment of a laminated layer fuel swirl element of an electromagnetic fuel injector according to the present invention.

FIG. 5 and FIG. 6 show further embodiments according to the present invention in a case where the movable valve is changed to a needle valve. FIG. 5 is a cross-sectional view of an essential portion of the nozzle portion 7 showing the surrounding portion of a needle valve 50, and FIG. 6 is a cross-sectional view of a laminated layer fuel swirl element 51. In these figures, the same reference numerals are used to describe the first embodiment represent the same components or elements.

In FIG. 6, the laminated layer swirl element 51 comprises four pieces, which include a cylindrical portion 51A, an upper plate 51B, a middle plate 51C, and a lower plate 51D, and the construction of the laminated layer swirl element 51 is similar to that of the first embodiment. The cylindrical portion 51A has a guide hole 52 to accommodate the movable portion 4A of the plunger 4, the end of which is comprised of the needle valve 50.

The construction of the fuel passage formed by the three plates 51B, 51C and 51D is similar to that of the first embodiment. However, a central hole 53, which communicates with the fuel passage, is formed to have a little larger diameter than the diameter of the guide hole 52.

In FIG. 5, after the four pieces comprised of the cylindrical portion 51A and the three plates 51B, 51C and 51D have laminated in series similar to the first embodiment, the four piece element is inserted and fixed to the inner wall 21 of the hollow portion of the nozzle member 7. An axial direction fuel passage 54 is formed between an outer peripheral wall of the fuel swirl element 51 and the inner wall 21 of the hollow portion of the nozzle member 7.

Further, by inserting the end of the movable portion 4A (the needle valve 50) into the hole 52, 53 in the nozzle portion, a fuel swirl chamber 55 is formed in the vicinity of the tip end of an outer peripheral portion of the needle valve 50. Namely, the fuel which is introduced from an upper portion of the needle valve 50 and has passed through the axial direction passage 54 is introduced eccentrically through the upper plate 51B and then has a swirl force imparted thereto, thereby producing a spray having a weak inertia force and a wide spreading angle.

Further, a fuel spray having a strong inertia force and a small spreading angle is generated by the lower plate 51D, which is arranged near the upper side of the seat face 9 of the nozzle member 7. This fuel spray is generated in the vicinity of the axial center as a fuel spray flow having a comparatively large velocity. As a result, the fuel spray in the form of a comparatively solid cone fuel spray is generated.

FIG. 7A and FIG. 7B are schematic diagrams showing the fuel spray obtained by the embodiment according to the present invention, which diagrams are based on photography taken with an electric flash. FIG. 7A is a view showing a complex fuel spray structure in which the droplet flow is mainly considered according to the present invention, and FIG. 7B is a view showing a complex fuel spray structure in which air flow is mainly considered according to the present invention.

As stated above, until the fuel reaches the injection hole 8 of the nozzle member 7, the fuel is separated according to the strong swirl flow from the upper portion axial direction passages and the weak swirl flow from the lower portion axial direction passages. As a result, small diameter droplets having a weak inertia force and a small velocity are generated at the outer peripheral portion of the fuel spray, and small diameter droplets (larger than the above stated outer peripheral portion droplets) having a strong inertia force and a large velocity are generated at the central portion of the fuel spray.

The small diameter droplets at the outer peripheral portion of the fuel spray are easily influenced by the affect of the surrounding air flow, as shown in FIG. 7B, and the small diameter droplets are divided into droplets which are directed toward the center of the fuel spray and are greatly influenced by the air flow and droplets which are directed downstream and are discharged toward the outside.

On the other hand, the small diameter droplets having the large velocity at the central portion of the fuel spray attract the small diameter droplets in the vicinity which are moving in the direction of the air flow. As a result, the dispersion of the droplets is promoted, so that a comparatively solid cone fuel spray structure is produced.

Further, as shown in FIG. 7A and FIG. 7B, taking into consideration a cross section of the fuel spray including the axial center of the valve body, the fuel spray structure of the fuel injector according to the present invention has three strong spray components directed in the D1 direction, the D2 direction and the D3 direction.

In other words, the fuel spray structure has three pattern spray components, including a straight pattern fuel spray component, a left radial pattern fuel spray component and a right radial pattern fuel spray component. The straight pattern fuel spray component in the D1 direction is directed toward the lower portion, the left radial pattern fuel spray component has D2 direction component and directs for the left radial portion, and the right radial pattern fuel spray component in the D3 direction component is directed toward the right radial portion. By uniting the straight pattern fuel spray component, the left radial pattern fuel spray component and the right radial pattern fuel spray component, a comparatively solid cone fuel spray structure according to the present invention is formed.

From a different point of view, the above fuel spray structure according to the present invention comprises a central fuel spray structure and a peripheral fuel spray structure. The central fuel spray structure is formed by the fuel which is directed in the D1 direction and exists at the central portion of the fuel spray. On the other hand, the peripheral fuel spray structure is formed by the fuel which is directed in the D2 direction and the D3 direction. The peripheral fuel spray structure is formed around the central fuel spray structure. By uniting the central fuel spray structure and the peripheral fuel spray structure, a comparatively solid cone fuel spray structure according to the present invention is formed.

FIG. 8 shows the construction of an internal combustion engine, such as used in an automobile, in which one embodiment of an electromagnetic injector according to the present invention is used. In the internal combustion engine, the fuel is injected directly into a combustion chamber of the internal combustion engine. FIG. 9 shows an enlarged view of the direct fuel injection system for the internal combustion engine in which one embodiment of an electromagnetic fuel injector according to the present invention is employed.

In FIG. 8, a four-cylinder four cycle gasoline engine 60 is connected directly to a high pressure fuel pump 71 through a belt 72. The high pressure fuel pump 71 pressurizes the fuel according to a cam drive, for example. In the high pressure fuel pump 71, by moving a piston, hydraulic compression is carried out so that high pressure fuel is obtained. The high pressure fuel pump 71 has a discharge port 71*a* and a suction port 71*b*. The discharge port 71*a* and a fuel gallery 75 of the engine 60 are connected by high pressure piping 73, and an accumulator 74 is provided at a midway point of the high pressure piping 73. To the fuel gallery 75, a respective direct fuel injection device 1 according to the present invention is connected for each cylinder.

A high pressure regulator 77 is provided downstream of the fuel gallery 75, and this high pressure regulator 77 maintains the supply pressure of the fuel to the direct fuel injection device 1 at constant level. Any superfluous fuel is introduced to a low pressure regulator 79 from the fuel gallery 73 and the high pressure regulator 77 through a lower pressure piping 78. Next, the superfluous fuel is passed through a return piping 84, which is connected to the lower pressure piping 79 and is returned to a fuel tank 81.

Plural direct fuel injection devices 1 are provided to accommodate a number of the cylinders. A driver circuit 85 for controlling each direct fuel injection device 1 is connected to a control unit 86 of the engine 60. The driver circuit 85 controls a supply amount etc. of the fuel to the direct fuel injection device 1 in accordance with various kinds of commands from the control unit 86 of the engine 60. The operation of the engine 60 is controlled through the control unit 86 in accordance with the inhale air amount, the air temperature, the engine water temperature, the engine rotation number etc.

Next, the above stated internal combustion engine 60 thus constituted will be explained in detail with reference to FIG. 9.

A piston 69 is provided to reciprocate in a cylinder 68 so as to be moved upwardly and downwardly in response to the rotation of an engine shaft (not shown in figure). A cylinder head 63 at an upper portion of the cylinder 68 forms an airtight enclosed space for the cylinder 68.

To the cylinder head 63, an air intake manifold 62 and an air discharge manifold are connected. The air intake manifold 62 leads the outside air to the cylinder 68 through an intake air amount control device 61 and the air discharge manifold leads the combustion gas which is produced by combustion in the cylinder 68 to an exhaust air device.

An air intake valve 64 is provided at the downstream side of the air intake manifold 62 in the cylinder head 63 and an ignition device 65 is provided at a central portion of the air intake manifold 62. Further, an air exhaust valve 66 is provided at the opposite side of the ignition device 65 from the air intake valve 64 in the cylinder head 63. The air intake valve 64 and the air exhaust valve 66 extend toward the combustion chamber 67 of the engine 60.

Herein, the direct fuel injection device 1 according to the present invention is installed in the vicinity of a portion where the air intake manifold 62 is connected to the cylinder head 63, and an injection of the fuel is set to be in a slightly downward direction into the combustion chamber 67. For example, the installation angle θp of the direct fuel injection device 1 is about 30°–40° degree. The piston 69 has a cavity 69A facing toward the fuel injection device.

In FIG. 9, a blank arrow shows the intake air flow and a hatched arrow shows the exhaust gas flow, respectively. The fuel of the internal combustion engine 60 is injected directly into the combustion chamber 67 by the direct fuel injection device 1 with a suitable timing relative the intake of air. An ignition signal is produced by the control unit 86 according to the driving parameters of the engine 60. The sprayed fuel due to the injection in the combustion chamber 67 is mixed with the air which is supplied through the air intake manifold 62.

At this time, a fuel spray having a large velocity at the central portion thereof is regulated in flow direction by the cavity 69A of the piston 69. Namely, as shown by the solid black arrow in FIG. 9, the flow direction of the fuel spray having a large velocity at the central portion thereof is directed toward the ignition device 65. On the other hand, the small diameter droplets having a small velocity at the outer peripheral portion of the fuel spray are dispersed in the combustion chamber 67, causing the mixture of fuel with the air to be promoted.

After that, the mixture of fuel and air is compressed during a compression stroke and is ignited stably by the ignition device 65, and, accordingly, the amount of unburned gas which remains is reduced and a stable combustion of fuel in the engine 60 can be realized.

As stated above, due to the laminated layer fuel swirl element, at the remote side from the fuel injection hole, the fuel has a strong swirl flow imparted thereto, and, on the other hand, at the side near to the fuel injection hole, the fuel weak swirl flow imparted thereto. As a result, a fuel spray having a large velocity, which is generated at the central portion thereof, attracts small diameter droplets which are generated at the outer peripheral portion of the fuel spray, and so a fuel spray having a superior dispersion characteristic can be formed.

Since the fuel spray thus obtained is supplied directly into the combustion chamber of the internal combustion engine, a good ignition characteristic can be provided in the engine, and also the amount of the unburned gas components of the combustion can be reduced.

Further, since the laminated layer fuel swirl element can be manufactured by press punch-out working, a high accuracy in the manufacture of the laminated layer fuel swirl element can be attained, and further a low cost of manufacture of the laminated layer fuel swirl element can be attained.

In the various embodiments of an electromagnetic fuel injector have been described, however the means for driving the valve body is not limited to an electromagnetic type system, and, for example, a piezoelectric type system can be employed.

According to the present invention, by imparting different swirl forces to the fuel prior to the fuel being injected, a fuel injector is provided in which a complex fuel spray is generated. Such a complex fuel spray structure having the large wide spreading angle component produced by making the inertia force weak and by shortening the distance or extent of travel of the fuel, and small spreading angle component produced by making the inertia force strong.

Further, by using the above stated fuel injector in an the internal combustion engine, a good ignition characteristic can be obtained in the internal combustion engine and the amount of unburned gas components of the combustion can be reduced.

What is claimed is:

1. In a fuel injector in which a swirl force is imparted to fuel to be injected, means for producing a fuel spray wherein, from an injection hole, a preceding spray is injected to a central area, and in succession to said preceding spray, another spray is injected radially to a surrounding area of said preceding spray, thereby a fuel injection spray having a solid cone shape is produced.

2. In a fuel injector in which a swirl force is imparted to fuel to be injected, means for producing a fuel wherein, from an injection hole, a first fuel spray is injected radially to an annular area, and simultaneously with said first fuel spray, a second fuel spray is injected to a central area within said annular area of said preceding spray, wherein said first fuel spray and said second fuel spray are overlapped in an axial direction, thereby a fuel injection spray having a solid cone shape is produced by the simultaneous injection of the first and second fuel sprays.

3. In a fuel injector in which a swirl force is imparted to fuel to be injected, means for producing a fuel wherein, a first fuel spray and a second fuel spray are simultaneously injected radially into an annular area, wherein the first and second fuel sprays directed in different directions and are overlapped in an axial direction of said fuel injector, and, a cross-section of the fuel spray shape, including an axial center of a valve body of said fuel injector, has strong spray distributions extending in three directions, thereby a fuel injection spray having a solid cone shape is produced by the simultaneous injection of the first and second fuel sprays.

4. A fuel injector comprising:

a nozzle body having an injection hole for injecting fuel and a seat face provided at an upstream side of said injection hole;

a valve body for carrying out an opening operation and a closing operation of a fuel passage at said seat face of said nozzle body; and at an upstream side of said seat face of said nozzle body, an element having a penetration hole in which said valve body extends, an axial direction fuel passage for passing fuel in an axial direction and a radial direction fuel passage communicating with said penetration hole from said axial direction fuel passage for passing fuel in a radial direction, wherein said radial direction fuel passage includes a first radial direction passage and a second radial direction passage displaced in said axial direction relative to each other;

said first radial direction passage being offset from the axis of the fuel injector by an amount which differs from an off-set amount of said second radial direction passage, thereby a fuel injection spray having a solid cone shape is produced.

5. A fuel injector comprising:

a nozzle body having an injection hole for injecting fuel and a seat face provided at an upstream side of said injection hole;

a valve body for carrying out an opening operation and a closing operation of a fuel passage at said seat face of said nozzle body; and at an upstream side of said seat face of said nozzle body, an element having a penetration hole in which said valve body extends, said element having an axial direction fuel passage for passing fuel in an axial direction and a radial direction fuel passage communicating with said penetration hole from said axial direction fuel passage for passing fuel in a radial direction; wherein said radial direction fuel passage includes two radial direction passages which are provided in two stages separated axially;

one of said two radial direction passages, which is provided relatively remote from said injection hole in communication with said penetration hole at an upstream end thereof, is offset from the axial center of said valve body by an amount which is the same or larger than an off-set amount of the other radial direction passage, which is provided relatively near said injection hole in communication with said penetration hole at a downstream end thereof, thereby a fuel injection spray having a solid cone shape is produced.

6. A fuel injector comprising:

a nozzle body having an injection hole for injecting fuel and a seat face provided an upstream side of said injection hole;

a valve body for carrying out an opening operation and a closing operation of a fuel passage at said seat face of said nozzle body; and at an upstream side of said seat face of said nozzle body, an element having a penetration hole in which said valve body extends, said element having an axial direction fuel passage for passing fuel in an axial direction and a radial direction fuel passage communicating with said penetration hole from said axial direction fuel passage for passing fuel in a radial direction; wherein said radial direction fuel passage includes two radial direction passages which are provided in two stages separated axially;

one of said two radial direction passages, which is provided relatively remote from said injection hole in communication with said penetration hole at an upstream end thereof, is offset from the axial center of said valve body by an amount which is smaller than an off-set amount of the other radial direction passage, which is provided relatively near said injection hole in communication with said penetration hole at a downstream end thereof, thereby a fuel injection spray having a solid cone shape is produced.

7. An internal combustion engine comprising a cylinder, a piston which reciprocates in said cylinder, air intake means for introducing air into said cylinder, discharge means for discharging combustion gas from said cylinder, a fuel injector for injecting fuel directly into said cylinder, fuel supply means for supplying fuel from a fuel tank to said fuel injector, and ignition means for igniting a mixture of air and fuel which comprises air introduced in said cylinder by said air intake means and fuel injected into said cylinder by said fuel injector, wherein said fuel injector comprises:

a nozzle body having an injection hole for fuel;

a valve body for carrying out an opening operation and a closing of said injection hole;

drive means for driving said valve body in an axial direction; and a first swirl force producing means and a second swirl force producing means, which are provided at an upstream side of said injection hole and are arranged in said axial direction relative to each other, each for imparting a swirl force to the fuel; whereby a swirl force imparted by said first swirl force producing means differs from a swirl force of said second swirl force producing means, thereby a fuel injection spray having a solid cone shape is produced.

8. An internal combustion engine comprising a cylinder, a piston which reciprocates in said cylinder, air intake means for introducing air into said cylinder, discharge means for discharging combustion gas from said cylinder, a fuel injector for injecting fuel directly into said cylinder, fuel supply means for supplying fuel from a fuel tank to said fuel injector, and ignition means for igniting a mixture of air and fuel which comprises air introduced in said cylinder by said air intake means and fuel injected into said cylinder by said fuel injector, wherein said fuel injector comprises:

a nozzle body having an injection hole for fuel;

a valve body for carrying out an opening and a closing of said injection hole;

drive means for driving said valve body in an axial direction; and two swirl force producing means which are provided upstream of said injection hole and are arranged axially with a two stage form; wherein, the swirl force producing means which is upstream imparts a stronger swirl force to the fuel than a swirl force produced by the other swirl force producing means which is provided downstream thereof, thereby a fuel spray having a solid cone shape is injected into said cylinder.

9. An internal combustion engine comprising a cylinder, a piston which reciprocates in said cylinder, air intake means for introducing air into said cylinder, discharge means for discharging combustion gas from said cylinder, a fuel injector for injecting fuel directly into said cylinder, fuel supply means for supplying fuel from a fuel tank to said fuel injector, and ignition means for igniting a mixture of air and fuel which comprises air introduced in said cylinder by said air intake means and fuel injected into said cylinder by said fuel injector, wherein said fuel injector comprises:

means for imparting a swirl force to the fuel, and means for including an injection hole for injecting the fuel, such that the fuel is injected from said injection hole into said cylinder in such a manner that the velocity of a first spray component which is injected to a central portion from said injection hole is larger than the velocity of a second spray component which is injected radially at a surrounding portion of said first spray component, thereby a fuel injection spray having a solid cone shape is produced.

10. An internal combustion engine comprising a cylinder, a piston which reciprocates in said cylinder, air intake means for introducing air into said cylinder, discharge means for discharging combustion gas from said cylinder, a fuel injector for injecting fuel directly into said cylinder, fuel supply means for supplying fuel from a fuel tank to said fuel injector, and ignition means for igniting a mixture of air and fuel which comprises air introduced in said cylinder by said air intake means and fuel injected into said cylinder by said fuel injector, wherein said fuel injector comprises:

a nozzle body having an injection hole;

a valve body for carrying out an opening and a closing of said injection hole;

drive means for driving said valve body in an axial direction; and two swirl force producing means which are provided upstream of said injection hole and are arranged axially with a two stage form; wherein, the swirl force producing means which is upstream imparts a weaker swirl force to the fuel than a swirl force produced by the other swirl force producing means which is provided downstream thereof, thereby a fuel spray having a solid cone shape is injected into said cylinder.

11. An internal combustion engine comprising a cylinder, a piston which reciprocates in said cylinder, air intake means for introducing air into said cylinder, discharge means for discharging combustion gas from said cylinder, a fuel injector for injecting fuel directly into said cylinder, fuel supply means for supplying fuel from a fuel tank to said fuel injector, and ignition means for igniting a mixture of air and fuel which comprises air introduced in said cylinder by said air intake means and fuel injected into said cylinder by said fuel injector, wherein said fuel injector comprises:

means for imparting a swirl force to the fuel, and means including an infection hole for injecting the fuel, such that the fuel is injected from said injection hole into said cylinder in such a manner that the velocity of a first spray component which is injected to an annular area from said injection hole is made smaller than the velocity of a second spray component which is injected into said annular area of said first spray component, thereby a fuel injection spray having a solid cone shape is produced.

12. An internal combustion engine comprising a cylinder, a piston which reciprocates in said cylinder, intake air means for introducing air into said cylinder, discharge means for discharging combustion gas from said cylinder, a fuel injector having a valve body and for injecting fuel directly into said cylinder, fuel supply means for supplying fuel from a fuel tank to said fuel injector, and ignition means for igniting a mixture of air and fuel which comprises air introduced in said cylinder by said air intake means and fuel injected into said cylinder by said fuel injector, wherein said fuel injector comprises:

means for imparting a swirl force to the fuel and for injecting the fuel, such that the fuel is injected into said cylinder in a such manner that a cross-section of the fuel spray shape, including an axial center of said valve body of said fuel injectors has strong spray distributions extending in three directions, thereby a fuel injection spray having a solid cone shape is produced.

13. An internal combustion engine comprising a cylinder, a piston which reciprocates in said cylinder, air intake means for introducing air into said cylinder, discharge means for discharging combustion gas from said cylinder, a fuel injector for injecting fuel directly into said cylinder, fuel supply means for supplying fuel from a fuel tank to said fuel injector, and ignition means for igniting a mixture of air and fuel which comprises air introduced in said cylinder by said air intake means and fuel injected in said cylinder by said fuel injector, wherein said fuel injector comprises:

a nozzle body having an injection hole for injecting fuel and a seat face provided at an upstream side of said injection hole;

a valve body for carrying out an opening and a closing of a fuel passage at said seat face of said nozzle body;

drive means for driving said valve body in an axial direction; and an element provided at an upstream side of said seat face of said nozzle body;

said element having a penetration hole in which said valve body extends, an axial direction fuel passage for passing fuel in said axial direction and a radial direction fuel passage communicating with said penetration hole from said axial direction fuel passage for passing fuel in a radial direction;

said radial direction fuel passage including a first radial direction passage and a second radial direction passage displaced in said axial direction;

said first radial direction fuel passage being offset from the axis of said valve body by an amount which differs from an off-set amount of said second radial direction passage so that a different force is imparted to the fuel by said first radial direction passage relative to the force applied by said second radial direction passage, thereby a fuel injection spray having a solid cone shape is produced.

14. An internal combustion engine comprising a cylinder, a piston which reciprocates in said cylinder, air intake means for introducing air into said cylinder, discharge means for discharging combustion gas from said cylinder, a fuel injector for injecting fuel directly into said cylinder, fuel supply means for supplying fuel from a fuel tank to said fuel injector, and ignition means for igniting a mixture of air and fuel which comprises air introduced in said cylinder by said air intake means and fuel injected in said cylinder by said fuel injector, wherein said fuel injector comprises:

a nozzle body having an injection hole for injecting fuel and a seat face provided at an upstream side of said injection hole;

a valve body for carrying out an opening and a closing of a fuel passage at said seat face of said nozzle body;

drive means for driving said valve body in an axial direction; and an element provided at an upstream side of said seat face of said nozzle body;

said element having a penetration hole in which said valve body extends, an axial direction fuel passage for passing fuel in said axial direction and a radial direction fuel passage communicating with said penetration hole from said axial direction fuel passage for passing fuel in a radial direction;

said radial direction fuel passage includes two radial direction passages which are provided with a two stage form and are displaced axially relative to an axis of said injection hole;

one of said two radial direction passages, which is provided relatively remote from said injection hole in communication with said penetration hole at an upstream end thereof, is offset from the axial center of said valve body by an amount which is the same or larger than an off-set amount of the other radial direction passage which is provided relatively a near said injection hole in communication with said penetration hole at a downstream end thereof so that a different force is imparted to the fuel by said two radial direction passages as the fuel is injected into said cylinder, thereby a fuel injection spray having a solid cone shape is produced.

15. An internal combustion engine comprising a cylinder, a piston which reciprocates in said cylinder, air intake means for introducing air into said cylinder, discharge means for discharging combustion gas from said cylinder, a fuel injector for injecting fuel directly into said cylinder, fuel supply means for supplying fuel from a fuel tank to said fuel injector, and ignition means for igniting a mixture of air and fuel which comprises air introduced in said cylinder by said air intake means and fuel injected in said cylinder by said fuel injector, wherein said fuel injector comprises:

a nozzle body having an injection hole for injecting fuel and a seat face provided at an upstream side of said injection hole;

a valve body for carrying out an opening and a closing of a fuel passage at said seat face of said nozzle body;

drive means for driving said valve body axial direction; and an element provided at an upstream side of said seat face of said nozzle body;

said element having a penetration hole in which said valve body extends, an axial direction fuel passage for passing fuel in said axial direction and a radial direction fuel passage communicating with said penetration hole from said axial direction fuel passage for passing fuel in a radial direction;

said radial direction fuel passage including two radial direction passages which are provided with a two stage form and are displaced axially relative to an axis of said injection hole;

one of said two radial direction passages, which is provided relatively remote from said injection hole in communication with said penetration hole at an upstream end thereof, is offset from the axial center of said valve body by an amount which is smaller than an off-set amount of the other radial direction passage, which is provided relatively near said injection hole in communication with said penetration hole at a downstream end thereof so that a different force is imparted to the fuel by said two radial direction passages as the fuel is injected into said cylinder, thereby a fuel injection spray having a solid cone shape is produced.

16. An internal combustion engine according to any one of claims 7 to 15 wherein said piston has a cavity portion at an upper face thereof and said cavity portion changes the direction of said fuel spray which is injected from said fuel injector toward said ignition means.

17. A fuel injector comprising a nozzle body having an injection hole, a valve body, and a drive device to drive said valve body in an axial direction to cause said injection hole to be opened and closed so that fuel injection is carried out, wherein:

two swirl force producing fuel passages each to impart a swirl force to the fuel are arranged at an upstream side of said injection hole, and their outlets opened to a chamber made by said valve body and a valve seat face of a respective radial direction passage are separately arranged in the axial direction to each other, said two swirl force producing fuel passages comprising a first swirl force producing fuel passage to form a first fuel spray and a second swirl force producing fuel passage to form a second fuel spray, whereby a first swirl force imparted by said first force producing fuel passage is different from a second swirl force imparted by said second force producing fuel passage, thereby a fuel injection spray having a solid cone shape is produced by the simultaneous injection of the first and second fuel sprays.

18. A fuel injector comprising a nozzle body having an injection hole, a valve body, and a drive device to drive said valve body in an axial direction to cause said injection hole to be opened and closed so that fuel injection is carried out, wherein:

two swirl force producing fuel passages each to impart a swirl force to the fuel are arranged with a two stage form at an upstream side of said injection hole, and their outlets opened to a chamber made by said valve body and a valve seat face of a respective radial direction passage are separately arranged in the axial direction to each other, said two swirl force producing fuel passages including an upstream side swirl force producing a first fuel spray and a downstream side swirl force producing a second fuel spray, whereby said upstream side swirl force producing said first fuel spray imparts a stronger swirl force to the fuel than a swirl force produced by said downstream side swirl force producing said second fuel spray, thereby a fuel injection spray having a solid cone shape is produced by the simultaneous injection of the first and second fuels sprays.

19. A fuel injector comprising a nozzle body having an injection hole, a valve body, and a drive device to drive said valve body in an axial direction to cause said injection hole to be opened and closed so that fuel injection is carried out, wherein:

two swirl force producing fuel passages each to impart a swirl force to the fuel are arranged with a two stage form at an upstream side of said injection hole, and their outlets opened to a chamber made by said valve body and a valve seat face of a respective radial direction passage are separately arranged in the axial direction to each other, said two swirl force producing fuel passages including an upstream side swirl force producing a first fuel spray and a downstream side swirl force producing a second fuel spray, whereby said upstream side swirl force producing said fuel spray imparts a weaker swirl force to the fuel than a swirl force produced by said downstream side swirl force producing said second fuel spray, thereby a fuel injection spray having a solid cone shape is produced by the simultaneous injection of the first and second fuel sprays.

20. A fuel injector comprising a nozzle body having an injection hole, a valve body, and a drive device to drive said valve body in an axial direction to cause said injection hole to be opened and closed so that fuel injection is carried out, wherein:

two swirl force producing fuel passages each to impart a swirl force to the fuel are arranged at an upstream side of said injection hole, and their outlets opened to a space made by said valve body and said nozzle body are separately arranged in the axial direction to each other, said two swirl force producing fuel passages comprising a first swirl force producing a first fuel spray and a second swirl force producing a second fuel spray, whereby a first swirl force imparted by said first swirl force producing said fuel spray is different from a second swirl force imparted by said second force producing said second fuel spray, thereby a fuel injection spray having a solid cone shape is produced by the simultaneous injection of the first and second fuel sprays.

* * * * *